US009194386B2

(12) United States Patent
Hu et al.

(10) Patent No.: US 9,194,386 B2
(45) **Date of Patent: *Nov. 24, 2015**

(54) LINEAR COMPRESSOR HAVING A CONTROLLER AND METHOD FOR CONTROLLING A LINEAR COMPRESSOR

(75) Inventors: Jin Seok Hu, Masan-si (KR); Shin Hyun Park, Busan (KR); Yong Tae Kim, Gimhae-si (KR); Hoon Bong Lee, Changwon-si (KR); Kye Lyong Kang, Changnyeong-gun (KR)

(73) Assignee: LG ELECTRONICS INC., Seoul (KR)

( * ) Notice: Subject to any disclaimer, the term of this patent is extended or adjusted under 35 U.S.C. 154(b) by 469 days.

This patent is subject to a terminal disclaimer.

(21) Appl. No.: 13/510,294

(22) PCT Filed: Nov. 18, 2010

(86) PCT No.: PCT/KR2010/008159

§ 371 (c)(1),
(2), (4) Date: May 17, 2012

(87) PCT Pub. No.: WO2011/062427

PCT Pub. Date: May 26, 2011

(65) Prior Publication Data

US 2012/0230842 A1 Sep. 13, 2012

(30) Foreign Application Priority Data

Nov. 18, 2009 (KR) ..... 10-2009-0111585

(51) Int. Cl.
*F04B 49/06* (2006.01)
*F04B 35/04* (2006.01)

(52) U.S. Cl.
CPC ..... *F04B 35/045* (2013.01); *F04B 49/065* (2013.01); *F04B 2203/0402* (2013.01)

(58) Field of Classification Search
CPC ..... F04B 2203/04; F04B 2203/0401; F04B 2203/0402; F04B 2203/0404; F04B 17/03; F04B 17/04; F04B 49/20; F04B 49/065; F04B 49/06
USPC ..... 417/18, 44.11, 45, 416, 44.1
See application file for complete search history.

(56) References Cited

U.S. PATENT DOCUMENTS 5,032,772 A * 7/1991 Gully et al. ..... 318/135
6,537,034 B2 3/2003 Park et al.

(Continued)

FOREIGN PATENT DOCUMENTS

JP 2001-090659 4/2001
JP 2003-254249 9/2003

(Continued)

OTHER PUBLICATIONS

Chinese Office Action dated Feb. 20, 2014. (translation).

(Continued)

*Primary Examiner* — Alexander Comley
(74) *Attorney, Agent, or Firm* — Ked & Associates LLP

(57) ABSTRACT

A linear compressor is provided that provides a greater power by changing a frequency at high load. The linear compressor includes a mechanical device having a fixed member, a movable member linearly reciprocated in the fixed member, one or more springs provided to elastically support the movable member, and a motor connected to the movable member, and an electric controller having a rectifier, an inverter that receives a DC voltage from the rectifier, converts the DC voltage to an AC voltage, and supplies the AC voltage to the motor, a voltage sensor that senses the DC voltage, a current sensor that senses a current, and a controller that calculates a required voltage for the motor, generates a control signal, and applies the control signal to the inverter, if the required voltage is greater than the DC voltage of the voltage sensor.

11 Claims, 4 Drawing Sheets

(56) References Cited

U.S. PATENT DOCUMENTS

| | | | | |
|---|---|---|---|---|
| 7,025,571 | B2 * | 4/2006 | Jeun | 318/400.08 |
| 7,439,692 | B2 * | 10/2008 | Lee | 318/135 |
| 8,708,662 | B2 * | 4/2014 | Hu et al. | 417/44.11 |
| 2003/0129063 | A1 * | 7/2003 | Jeun | 417/45 |
| 2003/0161735 | A1 | 8/2003 | Kim et al. | |
| 2003/0177773 | A1 * | 9/2003 | Kim | 62/156 |
| 2006/0127225 | A1 * | 6/2006 | Kim et al. | 417/44.1 |
| 2006/0251523 | A1 * | 11/2006 | Lee et al. | 417/44.1 |
| 2007/0196214 | A1 * | 8/2007 | Bocchiola | 417/44.1 |
| 2009/0047138 | A1 * | 2/2009 | Yoo et al. | 417/44.11 |
| 2009/0047154 | A1 * | 2/2009 | Choi et al. | 417/417 |
| 2009/0097987 | A1 * | 4/2009 | Sung et al. | 417/44.11 |
| 2009/0148307 | A1 * | 6/2009 | Jeong et al. | 417/44.1 |

FOREIGN PATENT DOCUMENTS

| | | |
|---|---|---|
| KR | 10-0500528 | 7/2005 |
| KR | 10-0633155 | 10/2006 |
| KR | 10-2007-0092027 | 9/2007 |
| KR | 10-0764277 | 10/2007 |
| KR | 10-0801373 | 2/2008 |
| KR | 10-0845943 | 7/2008 |
| KR | 10-2010-0008307 | 1/2010 |

OTHER PUBLICATIONS

International Search Report with English Translation dated Oct. 24, 2011 (PCT/KR2011/001130).

* cited by examiner

LINEAR COMPRESSOR HAVING A CONTROLLER AND METHOD FOR CONTROLLING A LINEAR COMPRESSOR

TECHNICAL FIELD

The present invention relates to a linear compressor, and, more particularly, to a linear compressor which can provide greater power and cooling capacity by changing a frequency at a high load.

BACKGROUND ART

In general, a motor is provided in a compressor which is a mechanical apparatus for receiving power from a power generation apparatus, such as an electric motor, a turbine, etc. and compressing the air, refrigerant or other various operating gases to raise a pressure. The motor has been widely used in electric home appliances such as refrigerators, air conditioners, etc., and its application has been expanded to the whole industry.

Specifically, the compressors are roughly classified into a reciprocating compressor in which a compression space for sucking and discharging an operating gas is defined between a piston and a cylinder so that the piston can be linearly reciprocated in the cylinder to compress a refrigerant, a rotary compressor in which a compression space for sucking and discharging an operating gas is defined between an eccentrically-rotated roller and a cylinder so that the roller can be eccentrically rotated along the inner wall of the cylinder to compress a refrigerant, and a scroll compressor in which a compression space for sucking and discharging an operating gas is defined between an orbiting scroll and a fixed scroll so that the orbiting scroll can be rotated along the fixed scroll to compress a refrigerant.

Recently, a linear compressor which not only improves a compression efficiency but also has a simple structure has been actively developed among the reciprocating compressors. In particular, the linear compressor does not have a mechanical loss caused by a motion conversion since a piston is directly connected to a linearly-reciprocating driving motor.

FIG. 1 is a block diagram of a motor control device used in a conventional linear compressor.

As illustrated in FIG. 1, the motor control device includes a rectification unit having a diode bridge 11 receiving, rectifying and outputting AC power which is commercial power and a capacitor C1 smoothing the rectified voltage, an inverter unit 12 receiving a DC voltage, converting the DC voltage to an AC voltage according to a control signal from a control unit 17, and supplying the AC voltage to a motor unit, the motor unit having a motor 13 and a capacitor C2 connected in series to the motor 13, a voltage sensing unit 14 sensing a both-end voltage of the capacitor C1, a current sensing unit 15 sensing a current flowing through the motor unit, an operation unit 16 operating a counter electromotive force (EMF) from the voltage sensed by the voltage sensing unit 14 and the current sensed by the current sensing unit 15, and the control unit 17 generating a control signal by reflecting the counter EMF from the operation unit 16 and the current sensed by the current sensing unit 15.

In the conventional linear compressor shown in FIG. 1, additional costs and space are needed because the capacitor C2 connected in series to the motor 13 is provided in the linear compressor. In addition, although the cooling capacity modulation characteristics based on the load are determined by the capacity of the capacitor C2, in the prior art, it is not easy to change the capacity of the capacitor C2. Moreover, the preparation and selective connection of a plurality of capacitors cause difficulties in terms of cost, space, and design.

FIG. 2 is a graph showing changes of a stroke and an input voltage of the motor of FIG. 1. In the conventional linear compressor, if the capacitor C2 is removed in a simple manner, as shown in FIG. 2, a phenomenon in which a voltage applied to the motor is reduced, i.e., a jump phenomenon occurs near a top dead center (TDC), so that the cooling capacity modulation (under stroke operation) is impossible. In the graph of FIG. 2, the closer to 0.00, the closer to the TDC.

Further, in the prior art, if the capacitor is removed, a voltage higher than the DC voltage applied to the inverter unit may need to be applied to the motor in a high load condition. However, in the prior art, it can be solved merely by configuring an additional circuit, such as a voltage boosting technique.

DISCLOSURE

Technical Problem

An object of the present invention is to provide a linear compressor which can control cooling capacity modulation, even if a capacitor connected to a motor of the linear compressor is removed.

Another object of the present invention is to provide a linear compressor which can apply greater power to a motor with a smaller voltage in a high load condition.

A further object of the present invention is to provide a linear compressor which can generate a cooling capacity corresponding to a high load, by reducing a required voltage to a motor without connecting an additional circuit.

Technical Solution

According to an aspect of the present invention, there is provided a linear compressor comprising: a mechanical unit including a fixed member having a compression space therein, a movable member linearly reciprocated in the fixed member to compress a refrigerant sucked into the compression space, one or more springs provided to elastically support the movable member in the motion direction of the movable member, and a motor connected to the movable member to linearly reciprocate the movable member in the axial direction; and an electric control unit including a rectification unit receiving AC power and outputting a DC voltage, an inverter unit receiving the DC voltage, converting the DC voltage to an AC voltage according to a control signal, and supplying the AC voltage to the motor, a voltage sensing unit sensing the DC voltage output from the rectification unit, a current sensing unit sensing a current flowing between the motor and the inverter unit, and a control unit calculating a required voltage of the motor from the current from the current sensing unit, and generating a control signal for changing a frequency of the AC voltage converted by the inverter unit and applying the control signal to the inverter unit, if the required voltage is greater than the DC voltage of the voltage sensing unit.

In addition, the change degree of the frequency of the AC voltage may be proportional to a voltage difference between the required voltage and the DC voltage.

Moreover, the required voltage may be reduced according to the frequency change of the AC voltage.

Additionally, the control unit may integrate the current from the current sensing unit, operate an attenuation voltage by multiplying the integrated value by a constant (1/Cr), and operate the required voltage with a difference between the set voltage and the attenuation voltage.

Further, the control unit may generate a control signal for applying the AC voltage based on the currently set frequency to the motor and apply the control signal to the inverter unit, if the required voltage is equal to or smaller than the DC voltage of the voltage sensing unit.

According to another aspect of the present invention, there is provided a linear compressor comprising: a mechanical unit including a fixed member having a compression space therein, a movable member linearly reciprocated in the fixed member to compress a refrigerant sucked into the compression space, one or more springs provided to elastically support the movable member in the motion direction of the movable member, and a motor connected to the movable member to linearly reciprocate the movable member in the axial direction; and an electric control unit including a rectification unit receiving AC power and outputting a DC voltage, an inverter unit receiving the DC voltage, converting the DC voltage to an AC voltage according to a control signal, and supplying the AC voltage to the motor, and a control unit generating a control signal for changing a frequency of the AC voltage converted by the inverter unit and applying the control signal to the inverter unit at a high load.

According to a further aspect of the present invention, there is provided a method for controlling a linear compressor, the method including: applying a DC voltage to an inverter unit; converting, at the inverter unit, the DC voltage to an AC voltage according to a control signal and applying the AC voltage to a motor; sensing a current flowing between the motor and the inverter unit; calculating a required voltage of the motor from the sensed current; and generating a control signal for changing a frequency of the AC voltage applied from the inverter unit to the motor and applying the control signal to the inverter unit, if the calculated required voltage is greater than the DC voltage applied to the inverter unit.

Advantageous Effects

According to the present invention, it is possible to control the cooling capacity modulation, even if the capacitor connected to the motor of the linear compressor is removed.

Additionally, according to the present invention, it is possible to apply greater power to the motor with a smaller voltage in the high load condition.

Moreover, according to the present invention, it is possible to generate the cooling capacity corresponding to the high load, by reducing the required voltage to the motor without connecting an additional circuit.

MODE FOR INVENTION

Hereinafter, exemplary embodiments of the present invention will be described in detail with reference to the attached drawings.

Figure 1:
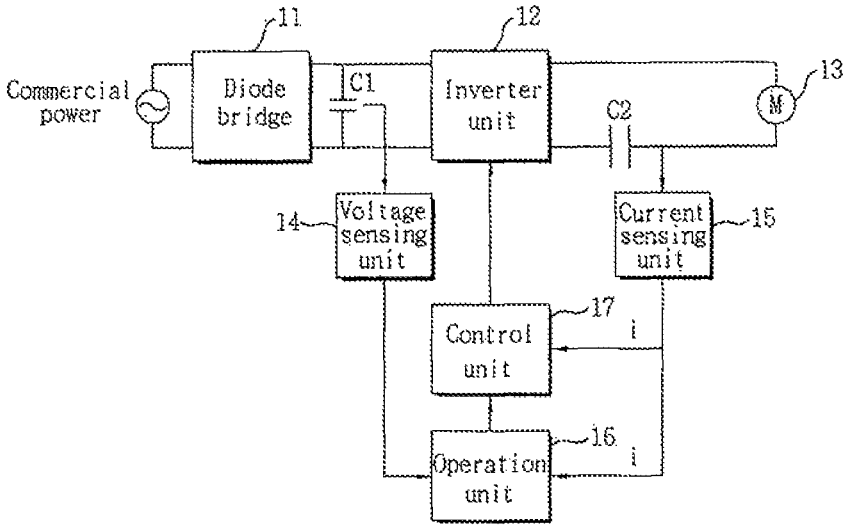
Figure 1 Conventional Art
FIG. 1 is a block diagram of a motor control device used in a conventional linear compressor.
Figure 2:
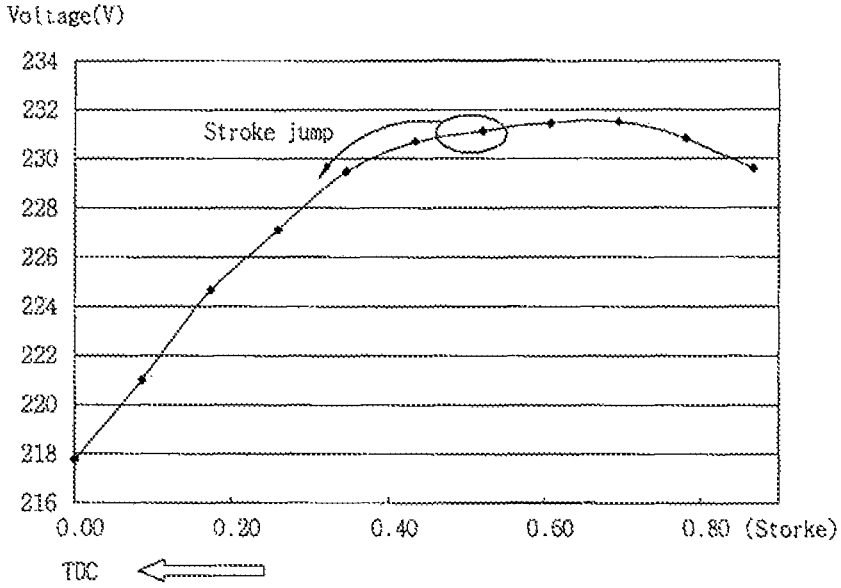
Figure 2 Conventional Art
FIG. 2 is a graph showing changes of a stroke and an input voltage of the motor of FIG. 1.
Figure 3:
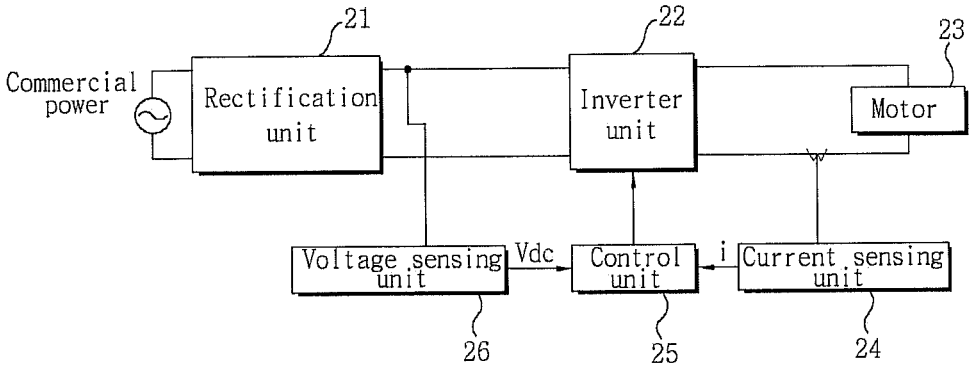
FIG. 3 is a block diagram of the control structure of a linear compressor according to the present invention.
Figure 4:
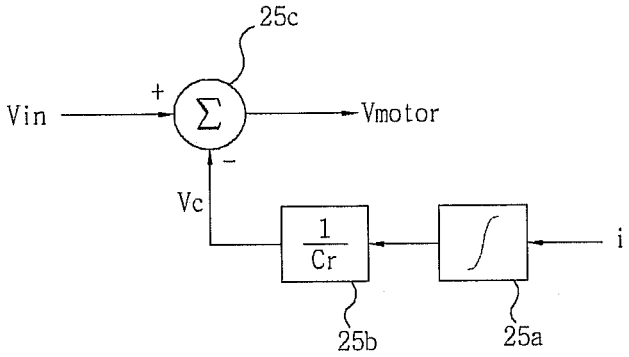
FIG. 4 is a circuit view of a control example of a control unit of FIG. 3.

FIG. 3 is a block diagram of the control structure of a linear compressor according to the present invention and FIG. 4 is a circuit view of a control example of a control unit of FIG. 3.

As illustrated in FIG. 3, the control structure of the linear compressor includes a rectification unit 21 receiving, rectifying, smoothing, and outputting AC power which is commercial power, an inverter unit 22 receiving a DC voltage, converting the DC voltage to an AC voltage according to a control signal from a control unit 25, and supplying the AC voltage to a motor 23, the motor 23 including a coil L, a current sensing unit 24 sensing a current flowing between the motor 23 and the inverter unit 22 or a current flowing through the coil L in the motor 23, a control unit 25 operating a motor application voltage Vmotor to be applied to the motor 23, based on the current sensed by the current sensing unit 24, generating a control signal for changing a frequency of the motor application voltage Vmotor according to a load condition, and applying the corresponding control signal to the inverter unit 22, and a voltage sensing unit 26 sensing the magnitude of the DC voltage from the rectification unit 21. However, in this control structure, the structure for supplying a required voltage to the control unit 25, the current sensing unit 24, the voltage sensing unit 26, etc. is obvious to a person of the ordinary skill in the art to which the present invention pertains, and thus a description thereof will be omitted.

The rectification unit 21 is composed of a diode bridge performing a general rectification function, a capacitor smoothing the rectified voltage, and so on.

The inverter unit 22, which is a means for receiving a DC voltage, generating an AC voltage, and applying the AC voltage to the motor 23, includes an IGBT (Insulated Gate Bipolar mode Transistor) element which is a switching element, a gate control unit turning on/off the IGBT element according to a control signal from the control unit 25, and so on. The inverter unit 22 is easily recognized by a person of the ordinary skill in the art to which the present invention pertains, and thus a description thereof will be omitted.

The motor 23 includes the coil L like a general motor of other mechanical structures but does not include a capacitor unlike the prior art.

The current sensing unit 24 is an element for sensing a current flowing through a conductive line between the inverter unit 22 and the motor 23 or a current flowing in the coil L of the motor 23.

The voltage sensing unit 26 is an element for sensing a DC voltage output from the rectification unit 21.

Here, the voltage sensing unit 26 can sense the entire DC voltage or a DC voltage reduced at a given ratio.

The control unit 25 generates a control signal for applying a preset application voltage Vin to the motor 23 and applies the control signal to the inverter unit 22, if it receives a linear compressor starting command from the outside or receives AC commercial power.

As a result, the inverter unit 22 generates an AC voltage corresponding to the application voltage Vin and applies the AC voltage to the motor 23.

Due to the application of this AC voltage, the current sensing unit 24 senses a current i flowing from the inverter unit 22 to the motor 23 or a current i flowing through the coil L of the motor 23.

The control unit 25 receives the current i from the current sensing unit 24 and performs the processing shown in FIG. 4.

The control unit 25 includes an integrator 25*a* integrating the current i from the current sensing unit 24, an attenuator 25*b* operating an attenuation voltage Vc by multiplying the integrated value by a constant 1/Cr, and an operation unit 25*c* operating a difference between the set application voltage Vin and the attenuation voltage Vc. That is, 'Vmotor=Vin−Vc' is satisfied. The application voltage Vin of this embodiment, which corresponds to the voltage applied by the inverter unit in the conventional compressor, is fixed or varied according to the control algorithm of the linear compressor.

The integrator 25*a* and the attenuator 25*b* correspond to the attenuation operation unit which attenuates the inductance effect of the coil L of the motor, using the current i flowing through the motor 23. That is, in this embodiment, since there is no capacitor connected to the coil L of the motor 23, the inductance effect of the coil L is reduced by controlling the motor application voltage Vmotor applied to the motor 23.

In addition, the constant 1/Cr used in the attenuator 25*b* may be fixedly or variably set according to the size of the coil L of the motor 23, wherein Cr is a capacitance. For example, when an LC resonance frequency is set to be equal to a mechanical resonance frequency of the compressor, the constant 1/Cr may be determined accordingly. Or, if the LC resonance frequency is set to be higher or lower than the mechanical resonance frequency of the compressor, the constant 1/Cr may be determined accordingly.

As such, after the motor application voltage Vmotor is operated, the control unit 25 generates a control signal for allowing the inverter unit 22 to apply the operated motor application voltage Vmotor to the motor 23 and applies the control signal to the inverter unit 22. That is, the control unit 25 allows the sensed current i to be fed back to the motor application voltage Vmotor, so that the operation of the motor 23 can be controlled in a state where the capacitor is not connected to the motor 23. In the present invention, since the counter electromotive force (EMF) is reflected to the current i and fed back, it needs not to be considered separately.

The higher the load, the greater the motor application voltage Vmotor which is the required voltage. In the present invention, if the motor application voltage Vmotor (i.e., the maximum value) which is the required voltage is greater than the DC voltage Vdc, a high load is determined. In the case of the high load, it is difficult for the inverter unit 22 to apply an AC voltage having a magnitude (the maximum value) equal to or greater than the DC voltage Vdc to the motor. Hence, the control unit 25 reduces the motor application voltage Vmotor which is the required voltage or maintains the required cooling capacity by changing the frequency of the AC voltage applied from the inverter unit 22 to the motor 23.

Figure 5:
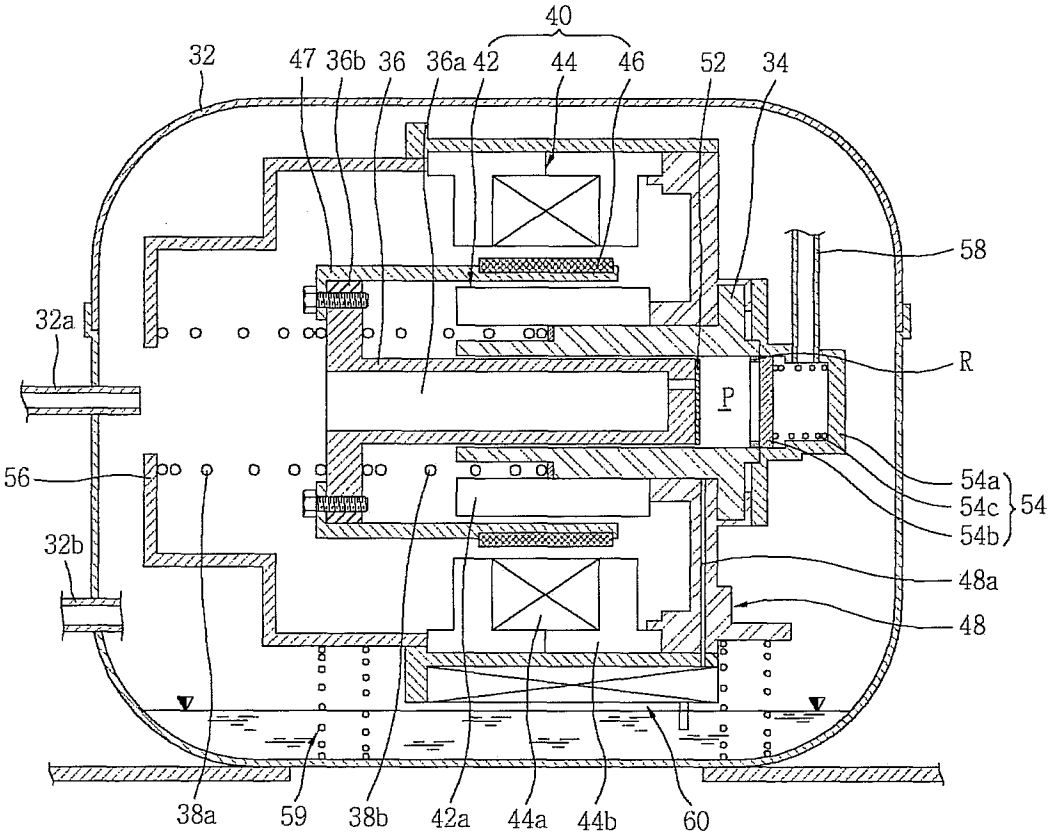
FIG. 5 is a structure view of the linear compressor according to the present invention.

FIG. 5 is a structure view of the linear compressor according to the present invention.

As illustrated in FIG. 5, in the linear compressor according to the present invention, an inlet pipe 32*a* and an outlet pipe 32*b* through which a refrigerant flows in and out are provided at one side of a hermetic container 32, a cylinder 34 is fixedly installed in the hermetic container 32, a piston 36 is provided to be linearly reciprocated in the cylinder 34 to be able to compress the refrigerant sucked into a compression space P in the cylinder 34, and various springs are provided to elastically support the piston 36 in the motion direction of the piston 36. The piston 36 is provided to be connected to a linear motor 40 which produces a linear reciprocation driving force. Although a natural frequency fn of the piston 36 is changed according to a load, the linear motor 40 induces a natural output change which modulates the cooling capacity (output) according to the changed load.

Moreover, a suction valve 52 is provided at one end of the piston 36 which is in contact with the compression space P and a discharge valve assembly 54 is provided at one end of the cylinder 34 which is in contact with the compression space P. The suction valve 52 and the discharge valve assembly 54 are automatically opened and closed according to the pressure inside the compression space P, respectively.

Here, the hermetic container 32 has its upper and lower shells coupled to each other to seal up the inside, the inlet pipe 32*a* for introducing the refrigerant and the outlet pipe 32*b* for discharging the refrigerant are provided at one side of the hermetic container 32, the piston 36 is elastically supported in the motion direction to be linearly reciprocated in the cylinder 34, and the linear motor 40 is coupled to the outside of the cylinder 34 by a frame 48 to constitute an assembly. This assembly is provided on the inside bottom surface of the hermetic container 32 to be elastically supported by supporting springs 59. Further, given oil is filled in the inside bottom surface of the hermetic container 32, an oil supply apparatus 60 pumping the oil is provided at a bottom end of the assembly, and an oil supply pipe 48*a* is provided in the frame 48 on the lower side of the assembly to be able to supply the oil between the piston 36 and the cylinder 34. Therefore, the oil supply apparatus 60 pumps out the oil due to the vibration caused by linear reciprocation of the piston 36, so that the oil is supplied to a gap between the piston 36 and the cylinder 34 along the oil supply pipe 48*a* and performs cooling and lubricating functions.

Next, it is preferable that the cylinder 34 should be formed in a hollow shape so that the piston 36 can be linearly reciprocated in the cylinder 34, have the compression space P at its one side, and be disposed in alignment with the inlet pipe 32*a* when its one end is positioned closely to the inside of the inlet pipe 32*a*.

Of course, the piston 36 is provided at one end of the cylinder 34 close to the inlet pipe 32*a* to be linearly reciprocated in the cylinder 34, and the discharge valve assembly 54 is provided at the other end of the cylinder 34 opposite to the inlet pipe 32*a*.

Here, the discharge valve assembly 54 includes a discharge cover 54*a* provided to define a given discharge space at a one-end side of the cylinder 34, a discharge valve 54*b* provided to open and close one end of the cylinder 34 near the compression space P, and a valve spring 54*c* which is a kind of coil spring applying an elastic force between the discharge cover 54*a* and the discharge valve 54*b* in the axial direction. An O-ring R is fitted into the inner circumference of one end of the cylinder 34 so that the discharge valve 54*a* can be closely attached to the one end of the cylinder 34.

Moreover, a bent loop pipe 58 is connected between one side of the discharge cover 54*a* and the outlet pipe 32*b*. The loop pipe 58 not only guides the compressed refrigerant to be discharged to the outside, but also prevents vibration produced by interactions between the cylinder 34, the piston 36 and the linear motor 40 from being transferred to the entire hermetic container 32.

Accordingly, as the piston 36 is linearly reciprocated in the cylinder 34, if the pressure inside the compression space P exceeds a given discharge pressure, the valve spring 54*c* is compressed to open the discharge valve 54*b*, so that the refrigerant is completely discharged from the compression space P to the outside along the loop pipe 58 and the outlet pipe 32*b*.

Next, a refrigerant passage 36*a* is defined in the center of the piston 36 so that the refrigerant introduced from the inlet pipe 32*a* can flow therethrough, the linear motor 40 is connected directly to one end of the piston 36 close to the inlet pipe 32*a* by a connection member 47, and the suction valve 52 is provided at the other end of the piston 36 opposite to the inlet pipe 32*a*. The piston 36 is elastically supported in its motion direction by various springs.

Here, the suction valve 52 is formed in a thin plate shape with its central portion partially cut away to open and close the refrigerant passage 36*a* of the piston 36 and with its one side fixed to one end of the piston 36 by screws.

*60 Therefore, as the piston 36 is linearly reciprocated in the cylinder 34, if the pressure of the compression space P becomes equal to or lower than a given suction pressure which is lower than a discharge pressure, the suction valve 52 is open, so that the refrigerant is sucked into the compression space P, and if the pressure of the compression space P exceeds the given suction pressure, the refrigerant is compressed in the compression space P with the suction valve 52 closed.

Particularly, the piston 36 is elastically supported in its motion direction. Specifically, a piston flange 36*b* protruding in the radial direction from one end of the piston 36 close to the inlet pipe 32*a* is elastically supported in the motion direction of the piston 36 by mechanical springs 38*a* and 38*b* such as coil springs, and the refrigerant contained in the compression space P on the opposite side to the inlet pipe 32*a* operates as a gas spring due to its own elastic force, thereby elastically supporting the piston 36.

Here, the mechanical springs 38*a* and 38*b* have a constant mechanical spring constant Km regardless of the load. It is preferable that the mechanical springs 38*a* and 38*b* should be provided respectively on the cylinder 34 and a given supporting frame 56 fixed to the linear motor 40 side by side in the axial direction, based on the piston flange 36*b*. It is preferable that the mechanical spring 38*a* supported on the supporting frame 56 and the mechanical spring 38*b* provided on the cylinder 34 should have the same mechanical spring constant Km.

However, the gas spring has a gas spring constant Kg changed according to the load. As the ambient temperature rises, the pressure of the refrigerant increases, and thus a own elastic force of the gas contained in the compression space P increases. Therefore, the higher the load, the larger the gas spring constant Kg of the gas spring. Here, while the mechanical spring constant Km is constant, the gas spring constant Kg is changed according to the load. As a result, the entire spring constant is changed according to the load, and the natural frequency fn of the piston 36 is also changed according to the gas spring constant Kg.

Accordingly, even if the load is changed, the mechanical spring constant Km and the mass M of the piston 36 are constant, but the gas spring constant Kg is changed, so that the natural frequency fn of the piston 36 is significantly influenced by the gas spring constant Kg depending upon the load.

Of course, the load can be measured in various ways. However, since the linear compressor includes a freezing/air conditioning cycle for compressing, condensing, evaporating and expanding the refrigerant, the load can be defined as a difference between a condensation pressure at which the refrigerant is condensed and an evaporation pressure at which the refrigerant is evaporated, and further is determined in consideration of an average pressure which is an average of the condensation pressure and the evaporation pressure so as to improve the accuracy.

That is, the load is calculated to be proportional to the difference between the condensation pressure and the evaporation pressure and the average pressure thereof. The higher the load, the larger the gas spring constant Kg. For example, the larger the difference between the condensation pressure and the evaporation pressure, the higher the load. Although the difference between the condensation pressure and the evaporation pressure is the same, the higher the average pressure, the higher the load. The gas spring constant Kg is calculated so that it can be increased according to such a load. The linear compressor may include a sensor (pressure sensor, temperature sensor, etc.) to calculate the load.

Here, a condensation temperature substantially proportional to the condensation pressure and an evaporation temperature substantially proportional to the evaporation pressure are measured, and then the load is calculated to be proportional to a difference between the condensation temperature and the evaporation temperature and an average temperature thereof.

Specifically, the mechanical spring constant Km and the gas spring constant Kg can be determined by means of various experiments. If the ratio of the gas spring constant Kg to the entire spring constant increases, a resonance frequency of the piston 36 can be changed in a relatively wide range according to the load.

The linear motor 40 includes an inner stator 42 configured in a manner that a plurality of laminations 42*a* are stacked in the circumferential direction and fixed to the outside of the cylinder 34 by the frame 48, an outer stator 44 configured in a manner that a plurality of laminations 44*b* are stacked in the circumferential direction around a coil winding body 44*a* wound with a coil and provided outside the cylinder 34 by the frame 48 with a given gap from the inner stator 42, and a permanent magnet 46 positioned in the gap between the inner stator 42 and the outer stator 44 and connected to the piston 36 by the connection member 47. The coil winding body 44*a* may be fixed to the outside of the inner stator 42.

The linear motor 40 is one embodiment of the motor 23 described above.

Figure 6:
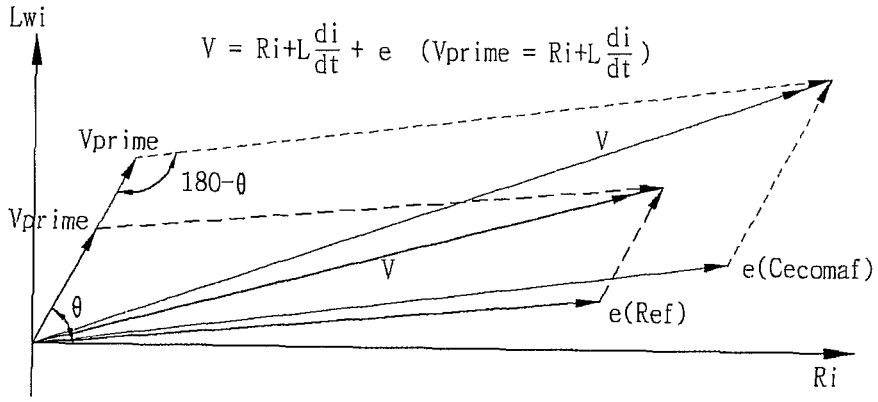
FIG. 6 is a vector diagram of the linear compressor according to the present invention.

FIG. 6 is a vector diagram of the linear compressor according to the present invention. The electrical equivalent circuit of the motor of the linear compressor according to the present invention is represented by the following Formula 1:

$$V\text{motor}=Ri+Ldi/dt+e \qquad \text{Formula 1}$$

Here, Vmotor represents a motor application voltage, R represents a resistance value of the motor coil, L represents an inductance value of the coil, i represents a current flowing through the coil of the motor, and e represents a counter EMF. In addition, 'Vprime=Ri+Ldi/dt' is defined.

As shown in FIG. 6, the counter EMF e(Ref) has a larger phase difference from Vprime than the counter EMF e(cecomaf) and has a reduced magnitude. It means that the condition of the counter EMF e(cecomaf) represents a higher load than the condition of the counter EMF e(Ref). When such a high load occurs, the frequency is changed to reduce the motor application voltage which is the required voltage.

Here, the higher the frequency, the larger the phase angle between the counter EMF e and Vprime. That is, as the phase difference between the counter EMF e and Ri decreases, greater power can be obtained with a smaller voltage. Using this principle, the control unit 25 can increase the phase angle between the counter EMF e and Vprime by increasing the frequency of the motor application voltage Vmotor or can decrease the phase angle between the counter EMF e and Vprime by decreasing the frequency.

Figure 7:
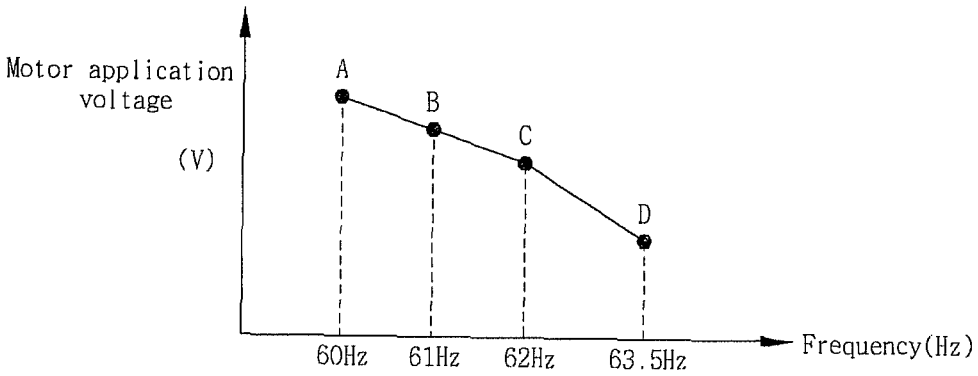
FIG. 7 is a graph showing the relationship between a frequency and a required voltage in the linear compressor according to the present invention.

FIG. 7 is a graph showing the relationship between the frequency and the required voltage in the linear compressor according to the present invention. As shown in FIG. 7, the magnitude of the motor application voltage Vmotor which is the required voltage and the frequency are almost inversely proportional to each other.

That is, a point A corresponds to a voltage having an operating frequency of 60 Hz. For example, in the case of a high load, a point B has an operating frequency of 61 Hz.

Moreover, the change degree of the frequency is increased according to the magnitude of the difference between the application voltage Vin and the attenuation voltage Vc (the difference between the maximum values)(Vin−Vc). For example, a difference c between the application voltage Vin and the attenuation voltage Vc at a point C may be larger than a difference b between the application voltage Vin and the attenuation voltage Vc at the point B. In consideration of a difference d between the application voltage Vin and the attenuation voltage Vc at a point D, if the difference d is reduced to the difference c, the control unit 25 operates the motor 23 by reducing the operating frequency to 62 Hz. That is, the control unit 25 selects the operating frequency among the previously-stored operating frequencies according to the difference between the application voltage Vin and the attenuation voltage Vc, so that the voltage corresponding to the selected operating frequency is applied to the motor 23.

The frequency is changed according to how large the motor application voltage Vmotor which is the difference between the application voltage Vin and the attenuation voltage Vc is, as compared with the DC voltage Vdc. That is, if the degree of largeness is high, the change width of the frequency increases, and if the degree of largeness is low, the change width of the frequency decreases.

As such, in the high load, the mechanical resonance frequency of the compressor becomes higher than e.g., 60 Hz, so the operating frequency is changed to correspond to the mechanical resonance frequency, which results in high power efficiency. Therefore, even if the motor application voltage decreases, it is possible to produce the cooling capacity corresponding to the load.

The present invention has been described in detail with reference to the exemplary embodiments and the attached drawings. However, the scope of the present invention is not limited to such embodiments and drawings, but is defined by the appended claims.

The invention claimed is:

1. A linear compressor, comprising:

a mechanical device including a fixed member having a compression space therein, a movable member linearly reciprocated in the fixed member to compress a refrigerant sucked into the compression space, one or more springs provided to elastically support the movable member in a motion direction of the movable member, and a motor connected to the movable member to linearly reciprocate the movable member in an axial direction; and an electric controller including:

a rectifier that receives an AC power and outputs a DC voltage;

an inverter that receives the DC voltage, converts the DC voltage to an AC voltage, and supplies the AC voltage to the motor;

a voltage sensor that senses the DC voltage output from the rectifier;

a current sensor that senses a current flowing between the motor and the inverter; and a controller that determines a required voltage of the motor based on the current sensed by the current sensor, and generates a control signal to change a frequency of the AC voltage converted by the inverter and applies the control signal to the inverter, if the required voltage is greater than the DC voltage sensed by the voltage sensor, wherein the controller integrates the current from the current sensor, operates an attenuation voltage by multiplying an integrated value by a constant (1/Cr), and operates the required voltage with a difference between a predetermined voltage and the attenuation voltage, and wherein Cr is a capacitance.

2. The linear compressor of claim 1, wherein a change degree of the frequency of the AC voltage is proportional to a voltage difference between the required voltage and the DC voltage.

3. The linear compressor of claim 2, wherein the required voltage is reduced according to the frequency change of the AC voltage.

4. The linear compressor of claim 1, wherein the required voltage is reduced according to the frequency change of the AC voltage.

5. The linear compressor of claim 1, wherein the controller generates a control signal to apply the AC voltage based on a currently set frequency to the motor and applies the control signal to the inverter, if the required voltage is equal to or smaller than the DC voltage sensed by the voltage sensor.

6. The linear compressor of claim 1, wherein the controller determines a high load if the required voltage is greater than the DC voltage sensed by the voltage sensor.

7. A method for controlling a linear compressor, the method comprising:

applying a DC voltage to an inverter;

converting, at the inverter, the DC voltage to an AC voltage and applying the AC voltage to a motor;

sensing a current flowing between the motor and the inverter;

determining a required voltage of the motor based on the sensed current; and generating a control signal to change a frequency of the AC voltage applied from the inverter to the motor and applying the control signal to the inverter, if the determined required voltage is greater than the DC voltage applied to the inverter, wherein the determining the required voltage includes integrating the sensed current, operating an attenuation voltage by multiplying an integrated value by a constant (1/Cr), and operating the required voltage with a difference between a predetermined voltage and the attenuation voltage, wherein Cr is a capacitance.

8. The method of claim 7, wherein a change degree of the frequency of the AC voltage is proportional to a voltage difference between the required voltage and the DC voltage.

9. The method of claim 8, wherein the determined required voltage is reduced according to the frequency change of the AC voltage.

10. The method of claim 7, wherein the determined required voltage is reduced according to the frequency change of the AC voltage.

11. The method of claim 7, further comprising generating a control signal to apply the AC voltage based on a currently set frequency to the motor and applying the control signal to the inverter, if the required voltage is equal to or smaller than the DC voltage sensed by the voltage sensor.

* * * * *